US012076830B2

(12) United States Patent
Kabasawa

(10) Patent No.: US 12,076,830 B2
(45) Date of Patent: Sep. 3, 2024

(54) POLISHING METHOD AND POLISHING APPARATUS

(71) Applicant: EBARA CORPORATION, Tokyo (JP)

(72) Inventor: Masashi Kabasawa, Tokyo (JP)

(73) Assignee: EBARA CORPORATION, Tokyo (JP)

( * ) Notice: Subject to any disclaimer, the term of this patent is extended or adjusted under 35 U.S.C. 154(b) by 0 days.

(21) Appl. No.: 18/187,786

(22) Filed: Mar. 22, 2023

(65) Prior Publication Data

US 2023/0219187 A1 Jul. 13, 2023

Related U.S. Application Data

(62) Division of application No. 16/894,173, filed on Jun. 5, 2020, now Pat. No. 11,642,751.

(30) Foreign Application Priority Data

Jun. 11, 2019 (JP) ..... 2019-108387
May 28, 2020 (JP) ..... 2020-093103

(51) Int. Cl.
*B24B 37/015* (2012.01)
*B24B 37/013* (2012.01)
*B24B 37/04* (2012.01)

(52) U.S. Cl.
CPC ..... *B24B 37/015* (2013.01); *B24B 37/013* (2013.01); *B24B 37/04* (2013.01); *B24B 37/042* (2013.01)

(58) Field of Classification Search
None
See application file for complete search history.

(56) References Cited

U.S. PATENT DOCUMENTS 10,589,398 B2 * 3/2020 Eto ..... B24B 55/02
2003/0055526 A1 3/2003 Avanzino et al.
2010/0081360 A1 4/2010 Xu et al.
2011/0159782 A1 * 6/2011 Sone ..... B24B 37/015 451/7

(Continued)

FOREIGN PATENT DOCUMENTS

JP 2005-026453 A 1/2005
JP 2011-136406 A 7/2011

(Continued)

*Primary Examiner* — Long Pham
(74) *Attorney, Agent, or Firm* — PEARNE & GORDON LLP

(57) ABSTRACT

A polishing method capable of terminating polishing of a substrate, such as a wafer, at a preset polishing time is disclosed. The polishing method includes: polishing a substrate by pressing the substrate against a polishing surface of a polishing pad, while regulating a temperature of the polishing surface by a heat exchanger; calculating a target polishing rate required for an actual polishing time to coincide with a target polishing time, the actual polishing time being a time duration from start of polishing the substrate until a film thickness of the substrate reaches a target thickness; determining a target temperature of the polishing surface that can achieve the target polishing rate; and during polishing of the substrate, changing a temperature of the polishing surface to the target temperature by the heat exchanger.

3 Claims, 10 Drawing Sheets

(56) References Cited

U.S. PATENT DOCUMENTS

| | | | | |
|---|---|---|---|---|
| 2014/0364040 | A1* | 12/2014 | Sone | B24B 37/015<br>451/7 |
| 2018/0236631 | A1* | 8/2018 | Eto | B24B 49/14 |
| 2019/0126428 | A1* | 5/2019 | Maruyama | F28G 1/166 |
| 2019/0308293 | A1* | 10/2019 | Kamiki | B24B 37/042 |

FOREIGN PATENT DOCUMENTS

| | | | |
|---|---|---|---|
| JP | 2012-508452 | A | 4/2012 |
| JP | 2017-148933 | A | 8/2017 |
| WO | 2010/053804 | A2 | 5/2010 |

* cited by examiner

POLISHING METHOD AND POLISHING APPARATUS

CROSS REFERENCE TO RELATED APPLICATION

This application is a divisional of U.S. patent application Ser. No. 16/894,173 filed on Jun. 5, 2020, which claims priorities to Japanese Patent Application Number 2019-108387 filed on Jun. 11, 2019, and Japanese Patent Application Number 2020-093103 filed on May 28, 2020, the entire contents of which are hereby incorporated by reference.

BACKGROUND

A CMP (chemical mechanical polishing) apparatus is used in a process of polishing a surface of a wafer in manufacturing of a semiconductor device. The CMP apparatus is configured to press the wafer against a polishing pad on a polishing table by a polishing head, while rotating the polishing table, to thereby polish the surface of the wafer. During polishing of the wafer, slurry is supplied onto the polishing pad. The surface of the wafer is planarized by the chemical action of the slurry and the mechanical action of abrasive grains contained in the slurry.

The CMP apparatus is a composite machine that performs polishing, cleaning, and drying of a wafer. Specifically, the wafer is polished by a polishing unit, and then the polished wafer is transported to a cleaning unit and the wafer is cleaned by the cleaning unit. Further, the cleaned wafer is transported to a drying unit, so that the wafer is dried in the drying unit. In this manner, polishing, cleaning, and drying of the wafer are sequentially performed.

A plurality of wafers stored in a wafer cassette are carried to the CMP apparatus, and these wafers are sequentially polished, cleaned, and dried by the CMP apparatus. A plurality of wafers (i.e., wafers to be polished) stored in one wafer cassette have the same film structure. Generally, polishing of each wafer is terminated when a thickness of a film that forms the surface of the wafer reaches a target thickness.

However, an initial film thickness varies slightly from wafer to wafer. As a result, a polishing time from the start of polishing to the end of polishing also varies slightly from wafer to wafer. If the polishing time of each wafer varies, a throughput becomes unstable. In particular, in a composite process of sequentially polishing, cleaning, and drying a plurality of wafers, polishing of the wafers becomes a rate-determining factor, and a processing time of the entire wafers becomes unstable.

SUMMARY OF THE INVENTION

Therefore, there are provided a polishing method and a polishing apparatus capable of terminating polishing of a substrate, such as a wafer, at a preset polishing time.

Embodiments, which will be described below, relate to a polishing method and a polishing apparatus for polishing a substrate, such as a wafer, while pressing the substrate against a polishing surface of a polishing pad, and more particularly to a polishing method and a polishing apparatus for polishing a substrate on a polishing surface of a polishing pad while adjusting a temperature of the polishing surface.

In an embodiment, there is provided a polishing method comprising: polishing a substrate by pressing the substrate against a polishing surface of a polishing pad, while regulating a temperature of the polishing surface by a heat exchanger; calculating a target polishing rate required for an actual polishing time to coincide with a target polishing time, the actual polishing time being a time duration from start of polishing the substrate until a film thickness of the substrate reaches a target thickness; determining a target temperature of the polishing surface that can achieve the target polishing rate; and during polishing of the substrate, changing a temperature of the polishing surface to the target temperature by the heat exchanger.

In an embodiment, calculating the target polishing rate comprises: calculating a remaining film thickness by subtracting the target thickness from a film thickness of the substrate at a present point in time; calculating a remaining time by subtracting an elapsed time from the target polishing time, the elapsed time being a period of time from start of polishing the substrate to the present point in time; and dividing the remaining film thickness by the remaining time, thereby calculating the target polishing rate.

In an embodiment, determining the target temperature of the polishing surface comprises determining the target temperature of the polishing surface corresponding to the target polishing rate based on a relational expression indicating a correlation between polishing rate and temperature of the polishing surface.

In an embodiment, the relational expression is a relational expression produced by: polishing one of sample substrates on the polishing surface of the polishing pad while keeping the temperature of the polishing surface constant by the heat exchanger; calculating a polishing rate of the one sample substrate; repeating polishing of one of the sample substrates and calculation of a polishing rate of the one sample substrate, while changing the sample substrate to be polished from one to another of the plurality of sample substrates and while changing the temperature of the polishing surface to another temperature, thereby obtaining a plurality of polishing rates corresponding to a plurality of temperatures of the polishing surface; and determining the relational expression indicating a correlation between the plurality of temperatures of the polishing surface and the plurality of polishing rates.

In an embodiment, the relational expression is a relational expression produced by: polishing a sample substrate on the polishing surface of the polishing pad while measuring a temperature of the polishing surface; calculating a plurality of polishing rates of the sample substrate corresponding to a plurality of temperatures of the polishing surface, respectively; and determining the relational expression indicating a correlation between the plurality of temperatures of the polishing surface and the plurality of polishing rates.

In an embodiment, there is provided a polishing method comprising: polishing a substrate by pressing the substrate against a polishing surface of a polishing pad, while regulating a temperature of the polishing surface by a heat exchanger; calculating a target polishing rate required for an actual polishing time to coincide with a target polishing time, the actual polishing time being a time duration from start of polishing the substrate until a film thickness of the substrate reaches a target thickness; and during polishing of the substrate, adjusting a temperature of the polishing surface by the heat exchanger such that a current polishing rate of the substrate is maintained at the target polishing rate.

In an embodiment, calculating the target polishing rate comprises: calculating a remaining film thickness by subtracting the target thickness from a film thickness of the substrate at a present point in time; calculating a remaining time by subtracting an elapsed time from the target polishing time, the elapsed time being a period of time from start of polishing the substrate to the present point in time; and dividing the remaining film thickness by the remaining time, thereby calculating the target polishing rate.

In an embodiment, adjusting the temperature of the polishing surface is performed within a temperature range that does not exceed a predetermined upper limit temperature, the upper limit temperature being determined based on a temperature of the polishing surface that maximizes a polishing rate of the substrate.

In an embodiment, there is provided a polishing apparatus comprising: a polishing table for supporting a polishing pad; a polishing head configured to polish a substrate by pressing the substrate against a polishing surface of the polishing pad; a heat exchanger having a heating flow passage and a cooling flow passage therein, the heat exchanger being arranged above the polishing table; a pad-temperature measuring device configured to measure a temperature of the polishing surface; a fluid supply system having a heating-fluid supply pipe and a cooling-fluid supply pipe coupled to the heating flow passage and the cooling flow passage, respectively; a film-thickness sensor attached to the polishing table; and an operation controller having a memory and a processing device, the memory storing a program therein, the processing device being configured to perform an arithmetic operation according to an instruction contained in the program, the operation controller being configured to calculate a target polishing rate required for an actual polishing time to coincide with a target polishing time, the actual polishing time being a time duration from start of polishing the substrate until a film thickness of the substrate reaches a target thickness, determine a target temperature of the polishing surface that can achieve the target polishing rate, and operate the fluid supply system during polishing of the substrate to change a temperature of the polishing surface to the target temperature by the heat exchanger.

In an embodiment, the operation controller is configured to: calculate a remaining film thickness by subtracting the target thickness from a film thickness of the substrate at a present point in time; calculate a remaining time by subtracting an elapsed time from the target polishing time, the elapsed time being a period of time from start of polishing the substrate to the present point in time; and divide the remaining film thickness by the remaining time to calculate the target polishing rate.

In an embodiment, the operation controller stores, in the memory, a relational expression indicating a correlation between polishing rate and temperature of the polishing surface, and the operation controller is configured to determine the target temperature of the polishing surface corresponding to the target polishing rate based on the relational expression.

In an embodiment, the relational expression is a relational expression produced by: polishing one of sample substrates on the polishing surface of the polishing pad while keeping the temperature of the polishing surface constant by the heat exchanger; calculating a polishing rate of the one sample substrate; repeating polishing of one of the sample substrates and calculation of a polishing rate of the one sample substrate, while changing the sample substrate to be polished from one to another of the plurality of sample substrates and while changing the temperature of the polishing surface to another temperature, thereby obtaining a plurality of polishing rates corresponding to a plurality of temperatures of the polishing surface; and determining the relational expression indicating a correlation between the plurality of temperatures of the polishing surface and the plurality of polishing rates.

In an embodiment, the relational expression is a relational expression produced by: polishing a sample substrate on the polishing surface of the polishing pad while measuring a temperature of the polishing surface; calculating a plurality of polishing rates of the sample substrate corresponding to a plurality of temperatures of the polishing surface, respectively; and determining the relational expression indicating a correlation between the plurality of temperatures of the polishing surface and the plurality of polishing rates.

In an embodiment, there is provided a polishing apparatus comprising: a polishing table for supporting a polishing pad; a polishing head configured to polish a substrate by pressing the substrate against a polishing surface of the polishing pad; a heat exchanger having a heating flow passage and a cooling flow passage therein, the heat exchanger being arranged above the polishing table; a pad-temperature measuring device configured to measure a temperature of the polishing surface; a fluid supply system having a heating-fluid supply pipe and a cooling-fluid supply pipe coupled to the heating flow passage and the cooling flow passage, respectively; a film-thickness sensor attached to the polishing table; and an operation controller having a memory and a processing device, the memory storing a program therein, the processing device being configured to perform an arithmetic operation according to an instruction contained in the program, the operation controller being configured to calculate a target polishing rate required for an actual polishing time to coincide with a target polishing time, the actual polishing time being a time duration from start of polishing the substrate until a film thickness of the substrate reaches a target thickness, and operate the fluid supply system during polishing of the substrate to adjust a temperature of the polishing surface by the heat exchanger such that a current polishing rate of the substrate is maintained at the target polishing rate.

In an embodiment, the operation controller is configured to: calculate a remaining film thickness by subtracting the target thickness from a film thickness of the substrate at a present point in time; calculate a remaining time by subtracting an elapsed time from the target polishing time, the elapsed time being a period of time from start of polishing the substrate to the present point in time; and divide the remaining film thickness by the remaining time to calculate the target polishing rate.

In an embodiment, the operation controller is configured to allow the heat exchanger to adjust the temperature of the polishing surface within a temperature range that does not exceed a predetermined upper limit temperature, the upper limit temperature being determined based on a temperature of the polishing surface that maximizes a polishing rate of the substrate.

According to the present invention, the film thickness of the substrate reaches the target thickness, and at the same time, the preset target polishing time is reached. Therefore, polishing of a plurality of substrates can be terminated at a constant polishing time, and as a result, the throughput can be stable.

DESCRIPTION OF EMBODIMENTS

Embodiments will now be described with reference to the drawings.

Figure 1:
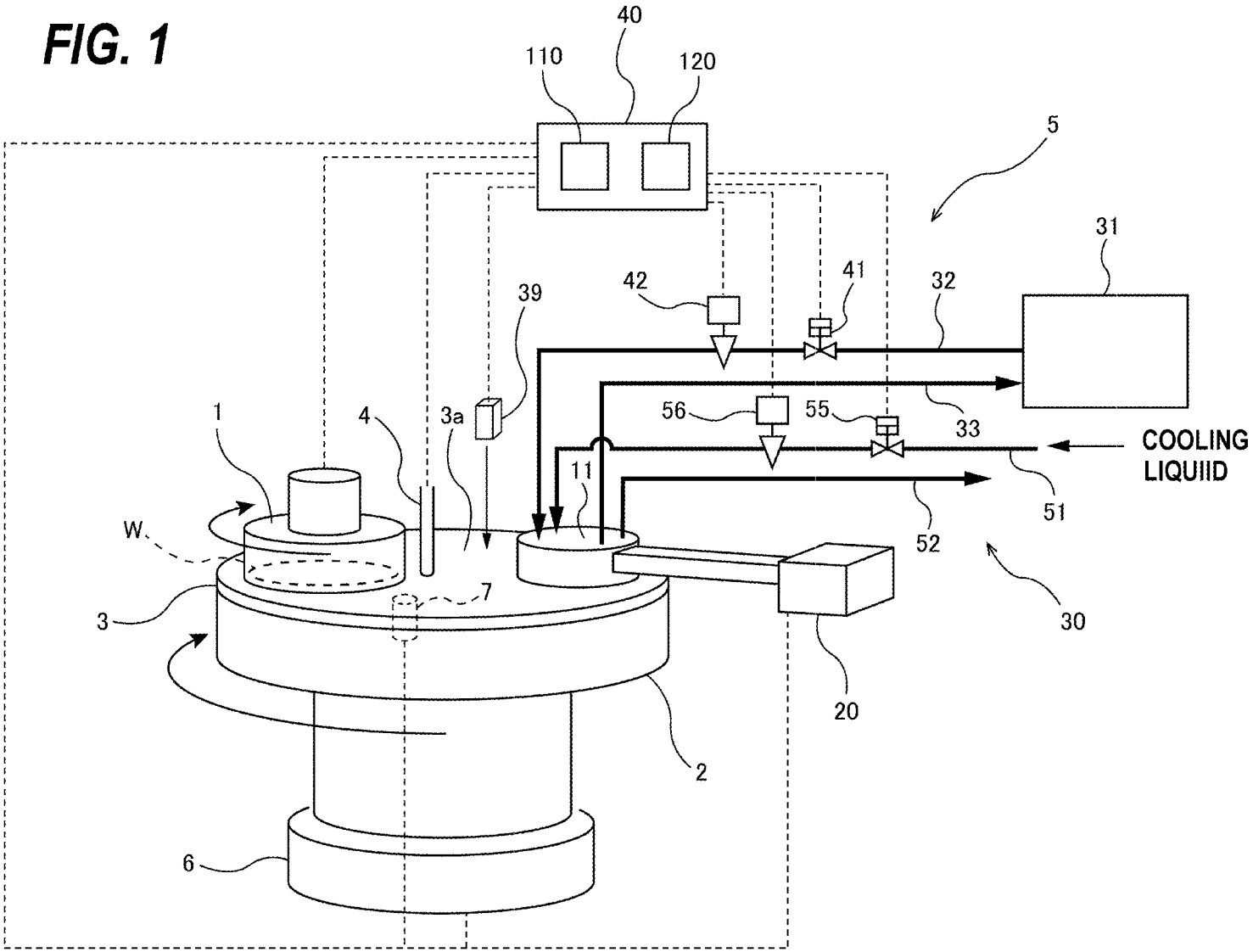
FIG. 1 is a schematic view showing an embodiment of a polishing apparatus.

FIG. 1 is a schematic view showing an embodiment of a polishing apparatus having a temperature regulation device. As shown in FIG. 1, the polishing apparatus includes a polishing head 1 for holding and rotating a wafer W which is an example of a substrate, a polishing table 2 that supports a polishing pad 3, a slurry supply nozzle 4 for supplying slurry onto a surface of the polishing pad 3, and a temperature regulation device 5 for regulating a temperature of a polishing surface 3*a* of the polishing pad 3. The surface (upper surface) of the polishing pad 3 provides the polishing surface 3*a* for polishing the wafer W.

The polishing head 1 is vertically movable, and is rotatable about its axis in a direction indicated by arrow. The wafer W is held on a lower surface of the polishing head 1 by, for example, vacuum suction. A table motor 6 is coupled to the polishing table 2, so that the polishing table 2 can rotate in a direction indicated by arrow. As shown in FIG. 1, the polishing head 1 and the polishing table 2 rotate in the same direction. The polishing pad 3 is attached to the upper surface of the polishing table 2.

The polishing apparatus includes an operation controller 40 for controlling operations of the polishing head 1, the table motor 6, the slurry supply nozzle 4, and the temperature regulation device 5. The operation controller 40 is constituted by at least one computer. The operation controller 40 includes a memory 110 storing programs therein, and an arithmetic device 120 that performs arithmetic operations according to instructions contained in the programs. The arithmetic device 120 includes a CPU (central processing unit) or GPU (graphics processing unit) that performs the arithmetic operations according to the instructions contained in the programs. The memory 110 includes a main memory (for example, a random-access memory) accessible by the arithmetic device 120, and an auxiliary memory (for example, a hard disk drive or a solid-state drive) that stores data and programs therein.

Polishing of the wafer W is performed as followings. The wafer W, to be polished, is held by the polishing head 1, and is then rotated by the polishing head 1. The polishing table 2 is rotated together with the polishing pad 3 by the table motor 6. While the wafer W and the polishing pad 3 are rotating, the slurry is supplied from the slurry supply nozzle 4 onto the polishing surface 3*a* of the polishing pad 3, and the surface of the wafer W is pressed by the polishing head 1 against the polishing surface 3*a* of the polishing pad 3. The surface of the wafer W is polished by the sliding contact with the polishing pad 3 in the presence of the slurry. The surface of the wafer W is planarized by the chemical action of the slurry and the mechanical action of abrasive grains contained in the slurry.

The polishing apparatus further includes a film-thickness sensor 7 configured to measure a film thickness of the wafer W. The film-thickness sensor 7 is fixed to the polishing table 2 and rotates together with the polishing table 2. The film-thickness sensor 7 is configured to generate a film-thickness signal that changes according to the film thickness of the wafer W. The film-thickness sensor 7 is arranged in the polishing table 2 and generates film-thickness signals indicating film thicknesses of a plurality of areas including a central portion of the wafer W each time the polishing table 2 makes one rotation. Examples of the film-thickness sensor 7 include an optical sensor and an eddy current sensor.

During polishing of the wafer W, the film-thickness sensor 7 rotates together with the polishing table 2, and generates the film-thickness signal while sweeping across the surface of the wafer W. This film-thickness signal comprises an index value that directly or indirectly indicates the film thickness of the wafer W. The film-thickness signal varies as the film thickness of the wafer W decreases. The film-thickness sensor 7 is coupled to the operation controller 40, so that the film-thickness signal is sent to the operation controller 40. When the film thickness of the wafer W, indicated by the film-thickness signal, reaches a predetermined target thickness, the operation controller 40 instructs the polishing head 1 and the polishing table 2 to terminate polishing of the wafer W.

The temperature regulation device 5 includes a heat exchanger 11 configured to regulate the temperature of the polishing surface 3*a* of the polishing pad 3 by performing heat exchange with the polishing pad 3. The temperature regulation device 5 further includes a fluid supply system 30 for supplying a heating fluid having a regulated temperature and a cooling fluid having a regulated temperature into the heat exchanger 11. The temperature regulation device 5 further includes an elevating mechanism 20 coupled to the heat exchanger 11. The heat exchanger 11 is located over the polishing table 2 and the polishing surface 3*a* of the polishing pad 3. The heat exchanger 11 has a bottom surface facing the polishing surface 3*a* of the polishing pad 3. The elevating mechanism 20 is configured to raise and lower the heat exchanger 11. More specifically, the elevating mechanism 20 is configured to move the bottom surface of the heat exchanger 11 in a direction toward the polishing surface 3*a* of the polishing pad 3 and in a direction away from the polishing surface 3*a* of the polishing pad 3. The elevating mechanism 20 includes an actuator (not shown), such as a motor or an air cylinder. The operation of the elevating mechanism 20 is controlled by the operation controller 40.

The fluid supply system 30 includes a heating-fluid supply tank 31 as a heating-fluid supply source for holding the heating fluid having a regulated temperature therein. The fluid supply system 30 further includes a heating-fluid supply pipe 32 and a heating-fluid return pipe 33, each coupling the heating-fluid supply tank 31 to the heat exchanger 11. Ends of the heating-fluid supply pipe 32 and the heating-fluid return pipe 33 are coupled to the heating-fluid supply tank 31, and the other ends are coupled to the heat exchanger 11.

The heating fluid having a regulated temperature is supplied from the heating-fluid supply tank 31 to the heat exchanger 11 through the heating-fluid supply pipe 32, flows in the heat exchanger 11, and is returned from the heat exchanger 11 to the heating-fluid supply tank 31 through the heating-fluid return pipe 33. In this manner, the heating fluid circulates between the heating-fluid supply tank 31 and the heat exchanger 11. The heating-fluid supply tank 31 has a heater (not shown in the drawings), so that the heating fluid is heated by the heater to have a predetermined temperature.

The fluid supply system 30 includes a first on-off valve 41 and a first flow-rate control valve 42 attached to the heating-fluid supply pipe 32. The first flow-rate control valve 42 is located between the heat exchanger 11 and the first on-off valve 41. The first on-off valve 41 is a valve not having a flow rate controlling function, whereas the first flow-rate control valve 42 is a valve having a flow rate controlling function.

The fluid supply system 30 further includes a cooling-fluid supply pipe 51 and a cooling-fluid discharge line 52, both coupled to the heat exchanger 11. The cooling-fluid supply pipe 51 is coupled to a cooling-fluid supply source (e.g., a cold water supply source) provided in a factory in which the polishing apparatus is installed. The cooling fluid is supplied to the heat exchanger 11 through the cooling-fluid supply pipe 51, flows in the heat exchanger 11, and is drained from the heat exchanger 11 through the cooling-fluid discharge line 52. In one embodiment, the cooling fluid that has flowed through the heat exchanger 11 may be returned to the cooling-fluid supply source through the cooling-fluid discharge line 52.

The fluid supply system 30 further includes a second on-off valve 55 and a second flow-rate control valve 56 attached to the cooling-fluid supply pipe 51. The second flow-rate control valve 56 is located between the heat exchanger 11 and the second on-off valve 55. The second on-off valve 55 is a valve not having a flow rate controlling function, whereas the second flow-rate control valve 56 is a valve having a flow rate controlling function.

The first on-off valve 41, the first flow-rate control valve 42, the second on-off valve 55, and the second flow-rate control valve 56 are coupled to the operation controller 40, so that the operations of the first on-off valve 41, the first flow-rate control valve 42, the second on-off valve 55, and the second flow-rate control valve 56 are controlled by the operation controller 40.

The temperature regulation device 5 further includes a pad-temperature measuring device 39 for measuring a temperature of the polishing surface 3*a* of the polishing pad 3 (which may hereinafter be referred to as pad surface temperature). The pad-temperature measuring device 39 is coupled to the operation controller 40. The operation controller 40 is configured to operate the first flow-rate control valve 42 and the second flow-rate control valve 56 based on the pad surface temperature measured by the pad-temperature measuring device 39. The first on-off valve 41 and the second on-off valve 55 are usually open. The pad-temperature measuring device 39 may be a radiation thermometer configured to measure the temperature of the polishing surface 3*a* of the polishing pad 3 in a non-contact manner. The pad-temperature measuring device 39 is disposed above the polishing surface 3*a* of the polishing pad 3.

The pad temperature measuring device 39 measures the pad surface temperature in a non-contact manner and sends the measured value of the pad surface temperature to the operation controller 40. The operation controller 40 operates the first flow-rate control valve 42 and the second flow-rate control valve 56 based on the measured pad surface temperature to regulate the flow rates of the heating fluid and the cooling fluid such that the pad surface temperature is maintained at a preset target temperature. The first flow-rate control valve 42 and the second flow-rate control valve 56 operate according to control signals from the operation controller 40, and regulate the flow rate of the heating fluid and the flow rate of the cooling fluid to be supplied to the heat exchanger 11. The heat exchange is performed between the polishing pad 3 and the heating fluid and cooling fluid flowing through the heat exchanger 11, whereby the pad surface temperature changes.

Such a feedback control allows the temperature of the polishing surface 3*a* of the polishing pad 3 (i.e., the pad surface temperature) to be maintained at the predetermined target temperature. PID control can be used as the feedback control. The target temperature of the polishing pad 3 is determined based on the type of film forming the surface of the wafer W or the polishing process. The determined target temperature is input in advance into the operation controller 40 and stored in the memory 110.

A heating liquid, such as hot water, may be used as the heating fluid supplied to the heat exchanger 11. The heating fluid is heated by a heater (not shown) of the heating-fluid supply tank 31 to have a temperature of about, for example, 80° C. In order to increase the surface temperature of the polishing pad 3 more quickly, silicone oil may be used as the heating fluid. When silicone oil is used as the heating fluid, the silicone oil is heated by the heater of the heating-fluid supply tank 31 to have a temperature of 100° C. or more (e.g., about 120° C.).

A cooling liquid, such as cold water or silicone oil, may be used as the cooling fluid supplied to the heat exchanger 11. In the case of using silicone oil as the cooling fluid, a chiller, which is the cooling-fluid supply source, may be coupled to the cooling-fluid supply pipe 51 so as to cool the silicone oil to 0° C. or less, so that the heat exchanger 11 can quickly cool the polishing pad 3. Pure water may be used as the cold water. A chiller may be used as the cooling-fluid supply source to cool the pure water to produce the cold water. In this case, the cold water that has flowed through the heat exchanger 11 may be returned to the chiller through the cooling-fluid discharge pipe 52.

The heating-fluid supply pipe 32 and the cooling-fluid supply pipe 51 are completely independent pipes. Therefore, the heating fluid and the cooling fluid are supplied to the heat exchanger 11 without being mixed with each other. The heating-fluid return pipe 33 and the cooling-fluid discharge line 52 are also completely independent pipes. Accordingly, the heating fluid is returned to the heating fluid supply tank 31 without being mixed with the cooling fluid, and the cooling fluid is drained or is returned to the cooling fluid supply source without being mixed with the heating fluid.

Figure 2:
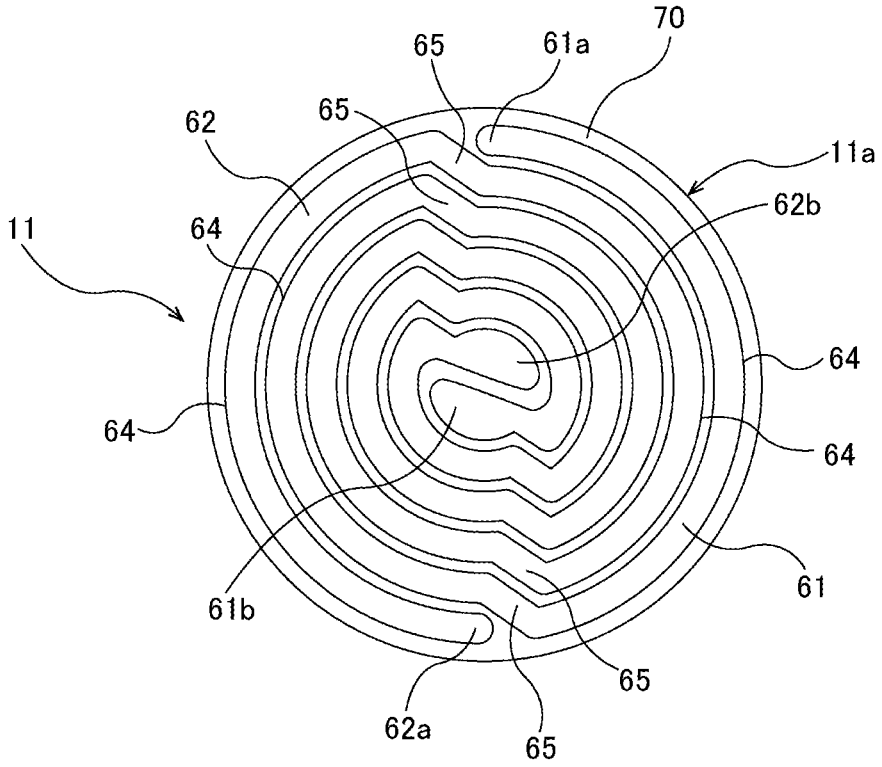
FIG. 2 is a horizontal cross-sectional view showing an embodiment of a heat exchanger.

Next, the heat exchanger 11 will be described with reference to FIG. 2. FIG. 2 is a horizontal cross-sectional view showing the heat exchanger 11. As shown in FIG. 2, the heat exchanger 11 includes a flow-passage structure 70 having a heating flow passage 61 and a cooling flow passage 62 formed therein. In the present embodiment, the entire heat exchanger 11 has a circular shape. The bottom surface of the heat exchanger 11 is flat and circular. The bottom surface of the heat exchanger 11 is constituted by a bottom surface of the flow-passage structure 70. The flow-passage structure 70 is made of a material having excellent wear resistance and high thermal conductivity, which may be ceramic, such as dense SiC.

The heating flow passage 61 and the cooling flow passage 62 are arranged next to each other (or side by side), and extend in a spiral shape. Further, the heating flow passage 61 and the cooling flow passage 62 have a shape of point symmetry, and have the same length. Each of the heating flow passage 61 and the cooling flow passage 62 basically comprises a plurality of arc flow passages 64 having a constant curvature and a plurality of inclined flow passages 65 coupling the arc flow passages 64. Two adjacent arc flow passages 64 are coupled by each inclined flow passage 65.

Such constructions make it possible to locate the outermost portions of the heating flow passage 61 and the cooling flow passage 62 at an outermost portion of the heat exchanger 11. Specifically, the entire bottom surface of the heat exchanger 11 lies under the heating flow passage 61 and the cooling flow passage 62. Therefore, the heating fluid and the cooling fluid can quickly heat and cool the polishing surface 3*a* of the polishing pad 3. The heat exchange between the polishing pad 3 and the heating fluid and cooling fluid is performed in a state such that the slurry is present between the polishing surface 3*a* of the polishing pad 3 and the bottom surface of the heat exchanger 11. It should be noted that the shapes of the heating flow passage 61 and the cooling flow passage 62 are not limited to the embodiment shown in FIG. 2, and the heating flow passage 61 and the cooling flow passage 62 may have other shapes.

The heating-fluid supply pipe 32 (see FIG. 1) is coupled to an inlet 61*a* of the heating flow passage 61, and the heating-fluid return pipe 33 (see FIG. 1) is coupled to an outlet 61*b* of the heating flow passage 61. The cooling-fluid supply pipe 51 (see FIG. 1) is coupled to an inlet 62*a* of the cooling flow passage 62, and the cooling-fluid discharge pipe 52 (see FIG. 1) is coupled to an outlet 62*b* of the cooling flow passage 62. The inlets 61*a* and 62*a* of the heating flow passage 61 and the cooling flow passage 62 are located at the peripheral portion of the heat exchanger 11, and the outlets 61*b* and 62*b* of the heating flow passage 61 and the cooling flow passage 62 are located at the central portion of the heat exchanger 11. Therefore, the heating fluid and the cooling fluid flow spirally from the peripheral portion toward the central portion of the heat exchanger 11. The heating flow passage 61 and the cooling flow passage 62 are completely separated, so that the heating fluid and the cooling fluid are not mixed in the heat exchanger 11.

Figure 3:
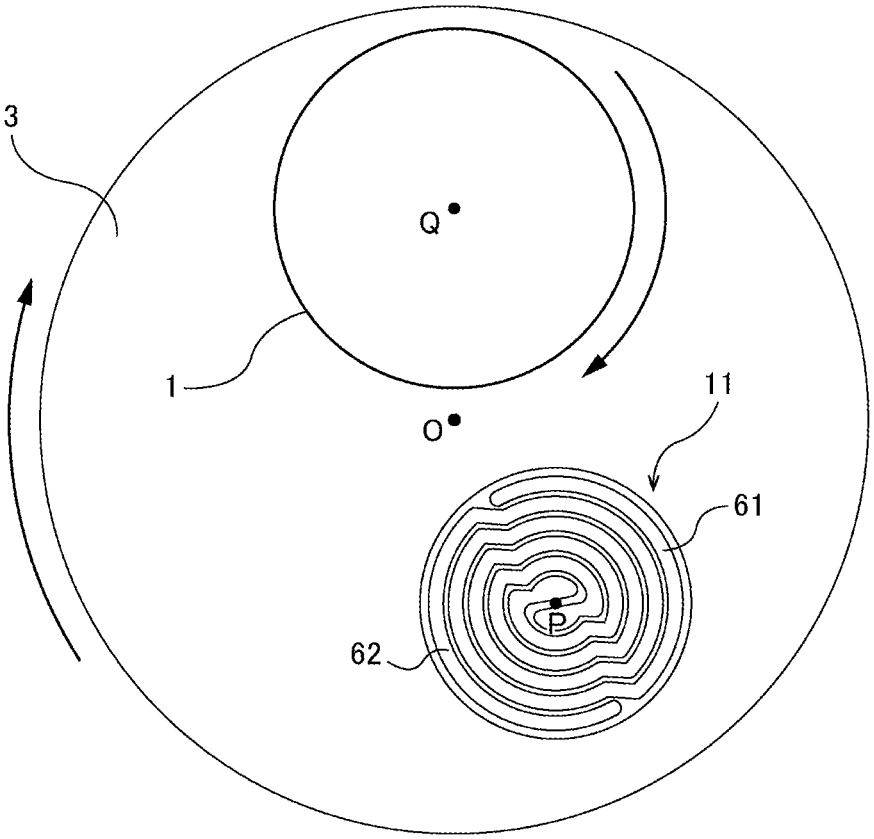
FIG. 3 is a plan view showing a positional relationship between the heat exchanger and a polishing head on a polishing pad.

FIG. 3 is a plan view showing a positional relationship between the heat exchanger 11 and the polishing head 1 on the polishing pad 3. The heat exchanger 11 has a circular shape when viewed from above, and has a diameter smaller than the diameter of the polishing head 1. A distance from the rotating center O of the polishing pad 3 to the center P of the heat exchanger 11 is equal to a distance from the rotating center O of the polishing pad 3 to the center Q of the polishing head 1. Since the heating flow passage 61 and the cooling flow passage 62 are adjacent to each other, the heating flow passage 61 and the cooling flow passage 62 are arranged not only along the radial direction of the polishing pad 3, but also along the circumferential direction of the polishing pad 3. Therefore, while the polishing table 2 and the polishing pad 3 are rotating, the polishing pad 3 performs the heat exchange with both of the heating fluid and the cooling fluid.

Referring back to FIG. 1, the operation controller 40 obtains, from the film-thickness sensor 7, the film-thickness signal that directly or indirectly indicates the film thickness of the wafer W during polishing of the wafer W. The operation controller 40 instructs the polishing head 1, the polishing table 2, etc. to terminate polishing of the wafer W when the film thickness of the wafer W has reached a preset target thickness. The target thickness is a numerical value that directly or indirectly indicates a target value of the film thickness of the wafer W. Furthermore, the operation controller 40 controls the temperature of the polishing surface 3*a* of the polishing pad 3 (i.e., the pad surface temperature) via the heat exchanger 11 such that an actual polishing time coincides with a preset target polishing time. The actual polishing time is a period of time from the start of polishing the wafer W until the film thickness of the wafer W reaches the target thickness.

More specifically, the operation controller 40 is configured to calculate a target polishing rate required for the actual polishing time (i.e., a time duration from the start of polishing the wafer W until the film thickness of the wafer W reaches the target thickness) to coincide with the preset target polishing time. The operation controller 40 is further configured to determine a target temperature of the polishing surface 3*a* that can achieve the calculated target polishing rate, and operate the fluid supply system 30 during polishing of the wafer W to change the temperature of the polishing surface 3*a* to the target temperature by the heat exchanger 11.

The operation controller 40 calculates the target polishing rate during polishing of the wafer W as follows. The operation controller 40 calculates a remaining film thickness by subtracting the target thickness from a film thickness of the wafer W at a present point in time. This present point in time is a certain point in time during polishing of the wafer W. The film thickness of the wafer W at the present point in time can be determined from the film-thickness signal transmitted from the film-thickness sensor 7. Next, the operation controller 40 calculates a remaining time by subtracting an elapsed time (i.e., a period of time from the start of polishing the wafer W to the present point in time) from the target polishing time. The operation controller 40 then divides the remaining film thickness by the remaining time, thereby calculating the target polishing rate.

The operation controller 40 determines the target temperature of the polishing surface 3*a* of the polishing pad 3 that can achieve the calculated target polishing rate. More specifically, the operation controller 40 determines the target temperature of the polishing surface 3*a* corresponding to the calculated target polishing rate based on a relational expression indicating a correlation between polishing rate and temperature of the polishing surface 3*a*. The relational expression showing the correlation between polishing rate and temperature of the polishing surface 3*a* is produced in advance based on measurement data of the polishing rate and the temperature of the polishing surface 3*a*. The measurement data can be obtained by an actual polishing process, such as experiments, polishing of a product wafer (or product substrate), or polishing of a sample wafer (or sample substrate). The operation controller 40 stores this relational expression in the memory 110 in advance.

Figure 4:
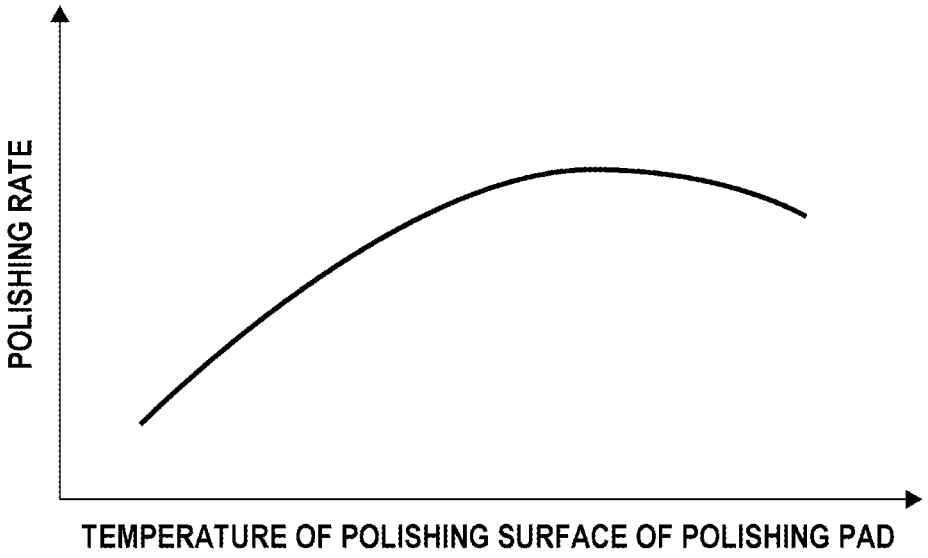
FIG. 4 is a graph showing an example of a relational expression indicative of a correlation between polishing rate and temperature of a polishing surface.

FIG. 4 is a graph showing an example of the relational expression showing the correlation between the polishing rate and the temperature of the polishing surface 3*a*. As shown in FIG. 4, the polishing rate of the wafer W changes depending on the temperature of the polishing surface 3*a* of the polishing pad 3. Therefore, the operation controller 40 can determine, from the relational expression, the temperature of the polishing surface 3*a* (i.e., the target temperature)

corresponding to the calculated target polishing rate. The operation controller 40 is configured to determine, during polishing of the wafer W, the target temperature of the polishing surface 3*a* of the polishing pad 3 that can achieve the target polishing rate.

Further, during polishing of the wafer W, the operation controller 40 operates the fluid supply system 30 to cause the heat exchanger 11 to change the temperature of the polishing surface 3*a* to the target temperature. More specifically, the operation controller 40 is configured to operate or manipulate the first flow-rate control valve 42 and the second flow-rate control valve 56 based on a difference between a current temperature of the polishing surface 3*a* and the target temperature. For example, when the current temperature of the polishing surface 3*a* is lower than the target temperature, the operation controller 40 increases the opening degree of the first flow-rate control valve 42 and decreases the opening degree of the second flow-rate control valve 56. The flow rate of the heating fluid flowing in the heat exchanger 11 increases, while the flow rate of the cooling fluid flowing in the heat exchanger 11 decreases. As a result, the temperature of the heat exchanger 11 itself rises, and the temperature of the polishing surface 3*a* rises. In this way, the operation controller 40 controls the temperature of the polishing surface 3*a* via the heat exchanger 11 by operating the first flow-rate control valve 42 and the second flow-rate control valve 56, so that the polishing rate of the wafer W can be adjusted.

Figure 5:
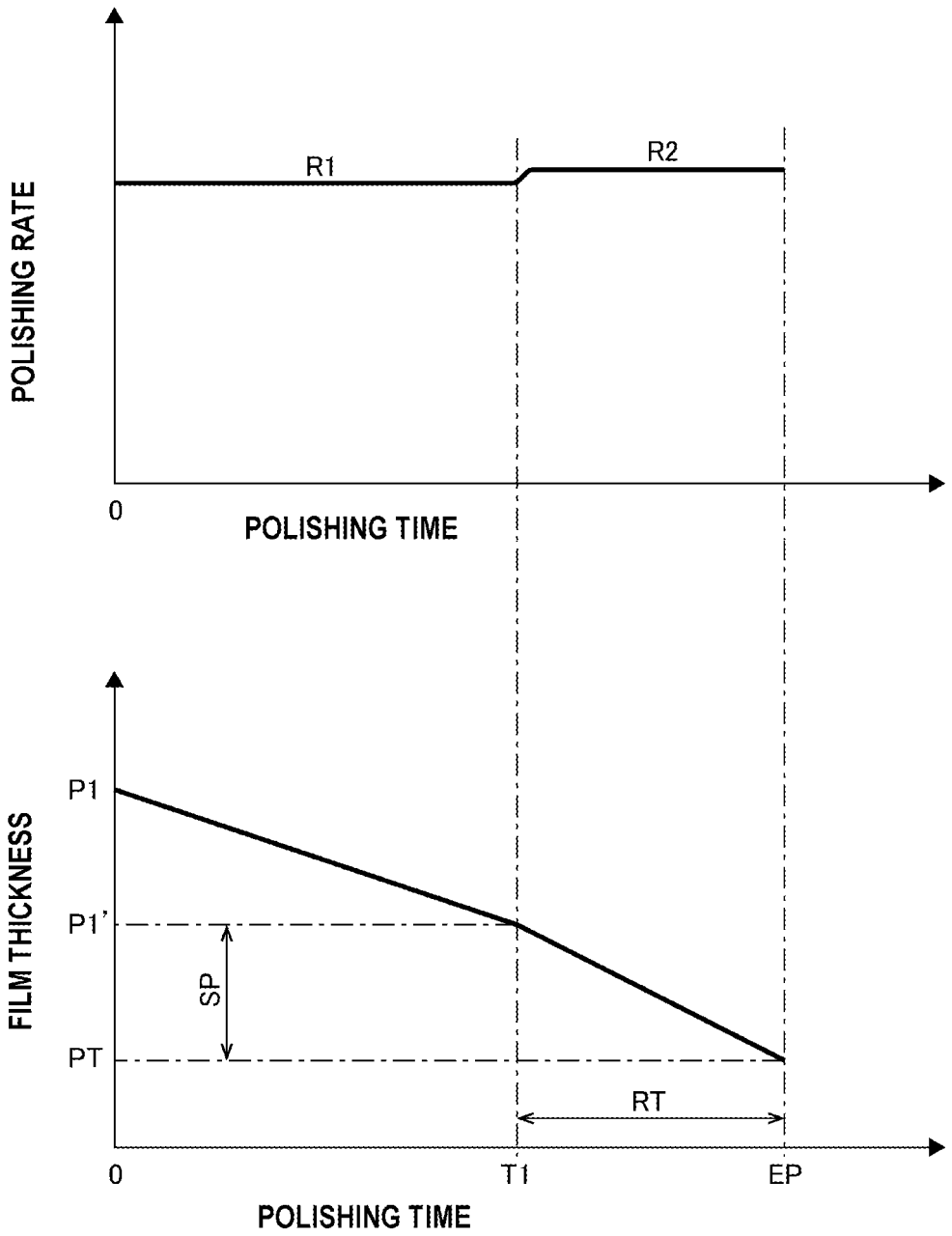
FIG. 5 is a diagram illustrating a graph showing an example of a change in the polishing rate with polishing time, and a graph showing an example of a change in film thickness with polishing time.

FIG. 5 is a graph showing an example of a change in the polishing rate with polishing time and a graph showing an example of a change in the film thickness with polishing time. The temperature of the polishing surface 3*a* of the polishing pad 3 is maintained at a set temperature by the heat exchanger 11. When polishing of the wafer W is started (polishing time 0), the wafer W is polished at a first polishing rate R1. As the wafer W is polished, the film thickness of the wafer W gradually decreases from its initial film thickness P1.

When the polishing time reaches a correction point T1 for the polishing rate, the operation controller 40, as described above, determines a target polishing rate required for an actual polishing time (i.e., a time duration from the start of polishing the wafer W until the film thickness of the wafer W reaches a target thickness PT) to coincide with a target polishing time EP. Specifically, the operation controller 40 calculates a remaining film thickness SP by subtracting the target thickness PT from a film thickness P1' of the wafer W at the present point in time T1, calculates a remaining time RT by subtracting an elapsed time (i.e., a time duration from the start of polishing the wafer W to the present point in time T1) from the target polishing time EP, and divides the remaining film thickness SP by the remaining time RT to determine a target polishing rate R2 (=SP/RT). Further, the operation controller 40 determines the target temperature of the polishing surface 3*a* that can achieve the target polishing rate R2 from the relational expression shown in FIG. 4, and operates the fluid supply system 30 during polishing of the wafer W to allow the heat exchanger 11 to change the temperature of the polishing surface 3*a* to the target temperature. As a result, the polishing rate of the wafer W changes from the first polishing rate R1 to the target polishing rate R2.

The wafer W is polished at the target polishing rate R2. When the film thickness of the wafer W reaches the target thickness PT, polishing of the wafer W is terminated. At this time, the polishing time (i.e., the actual polishing time) of the wafer W coincides with the target polishing time EP. Specifically, at the same time that the film thickness of the wafer W reaches the target thickness PT, the elapsed time from the start of polishing the wafer W reaches the target polishing time EP.

Figure 6:
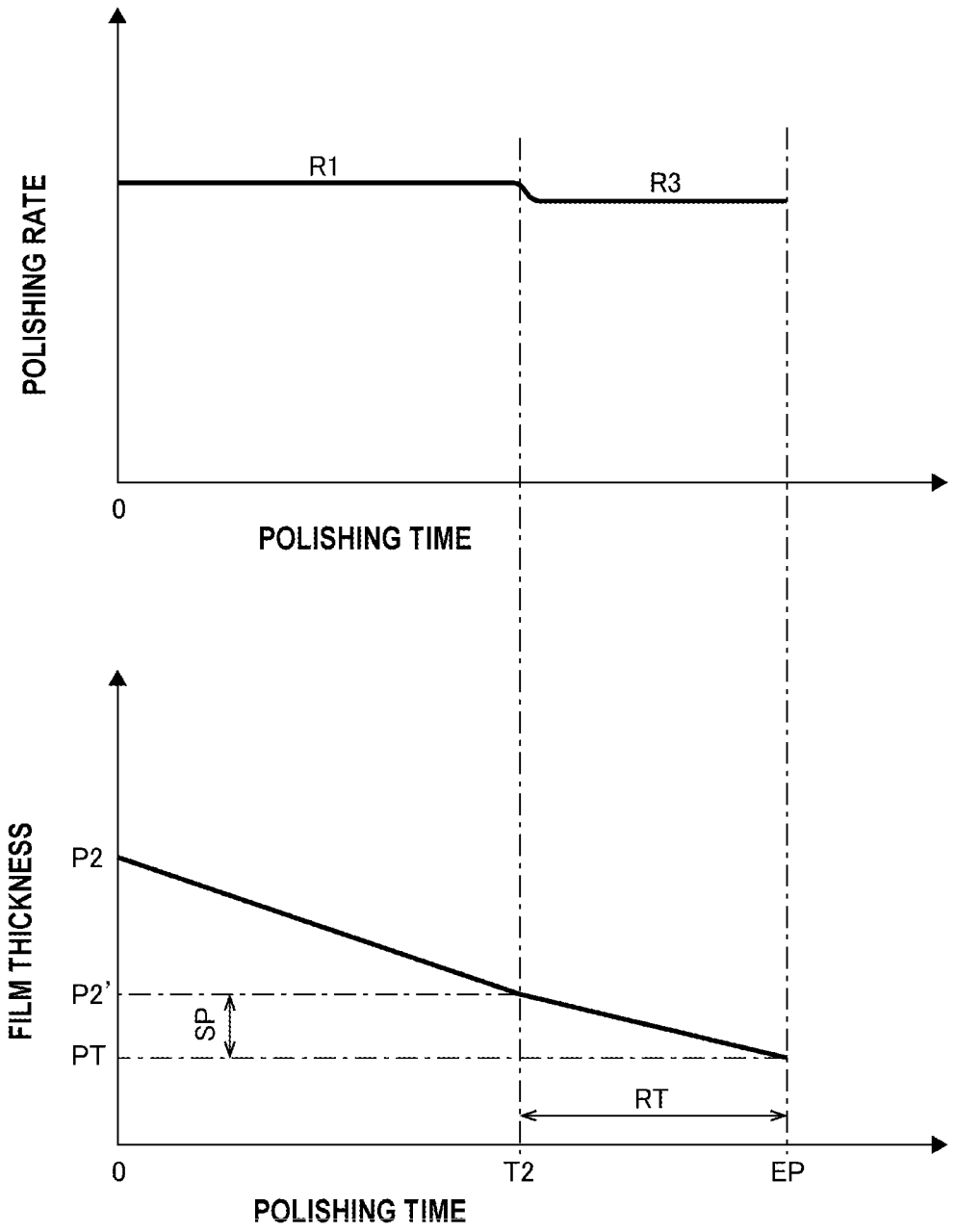
FIG. 6 is a diagram illustrating a graph showing another example of a change in the polishing rate with polishing time, and a graph showing another example of a change in film thickness with polishing time.

FIG. 6 is a graph showing another example of the change in the polishing rate with polishing time and a graph showing another example of the change in the film thickness with polishing time. The temperature of the polishing surface 3*a* of the polishing pad 3 is maintained at a set temperature by the heat exchanger 11. When the polishing of the wafer W is started (polishing time 0), the wafer W is polished at a first polishing rate R1. As the wafer W is polished, the film thickness of the wafer W gradually decreases from its initial film thickness P2. The initial film thickness P2 is smaller than the initial film thickness P1 shown in FIG. 5.

When the polishing time reaches a correction point T2 for the polishing rate, the operation controller 40, as described above, determines a target polishing rate required for an actual polishing time (i.e., a time duration from the start of polishing the wafer W until the film thickness of the wafer W reaches the target thickness PT) to coincide with the target polishing time EP. Specifically, the operation controller 40 calculates a remaining film thickness SP by subtracting the target thickness PT from a film thickness P2' of the wafer W at the present point in time T2, calculates a remaining time RT by subtracting an elapsed time (i.e., a time duration from the start of polishing the wafer W to the present point in time T2) from the target polishing time EP, and divides the remaining film thickness SP by the remaining time RT to determine a target polishing rate R3 (=SP/RT). Further, the operation controller 40 determines a target temperature of the polishing surface 3*a* that can achieve the target polishing rate R3 from the relational expression shown in FIG. 4, and operates the fluid supply system 30 during polishing of the wafer W to allow the heat exchanger 11 to change the temperature of the polishing surface 3*a* to the target temperature. As a result, the polishing rate of the wafer W changes from the first polishing rate R1 to the target polishing rate R3.

The wafer W is polished at the target polishing rate R3. When the film thickness of the wafer W reaches the target thickness PT, the polishing of the wafer W is terminated. At this time, the polishing time (i.e., the actual polishing time) of the wafer W coincides with the target polishing time EP. Specifically, at the same time that the film thickness of the wafer W reaches the target thickness PT, the elapsed time from the start of polishing the wafer W reaches the target polishing time EP.

The target thickness PT and the target polishing time EP shown in FIG. 6 are the same as the target thickness PT and the target polishing time EP shown in FIG. 5, respectively. The correction point T2 for the polishing rate shown in FIG. 6 is the same as the correction point T1 for the polishing rate shown in FIG. 5, but may be different. In one embodiment, a plurality of correction points may be set within the target polishing time EP. The operation controller 40 may calculate target polishing rates at these correction points, determine target temperatures of the polishing surface 3*a*, and change the temperature of the polishing surface 3*a* to each target temperature.

According to this embodiment, the time when the film thickness of the wafer W reaches the target thickness coincides with the time when the elapsed time from the start of polishing the wafer W reaches the target polishing time. Specifically, when a plurality of wafers having different initial film thicknesses are polished, the actual polishing times of the plurality of wafers are the same and coincide with the target polishing time. The polishing apparatus according to the present embodiment can terminate polishing of a plurality of wafers at a fixed polishing time, and as a result, can stabilize a throughput.

Next, an example of creating the relational expression showing the correlation between the polishing rate and the temperature of the polishing surface 3*a* shown in FIG. 4 will be described. While the temperature of the polishing surface 3*a* of the polishing pad 3 is kept constant by the heat exchanger 11, one of sample wafers (sample substrates) prepared in advance is polished on the polishing surface 3*a* of the polishing pad 3. Each of these sample wafers has a surface composed of the same type of film as the film that forms the surface of the wafer W (which is a product wafer or a product substrate) shown in FIG. 1. For example, the sample wafer may be a blanket wafer (blanket substrate) having a surface composed of a single film. Polishing of the sample wafer is performed under the same polishing conditions as those for the wafer W shown in FIG. 1.

When the one sample wafer is polished, the operation controller 40 calculates the polishing rate of that sample wafer. The polishing rate can be calculated by dividing a difference between an initial film thickness of the sample wafer and a film thickness after polishing by a polishing time.

Further, while changing the sample wafer to be polished from one to another of the plurality of sample wafers and while changing the temperature of the polishing surface 3*a* of the polishing pad 3 from one to another temperature, polishing of a sample wafer and calculation of a polishing rate are repeated. As a result, a plurality of polishing rates corresponding to a plurality of temperatures of the polishing surface 3*a* are obtained.

Figure 7:
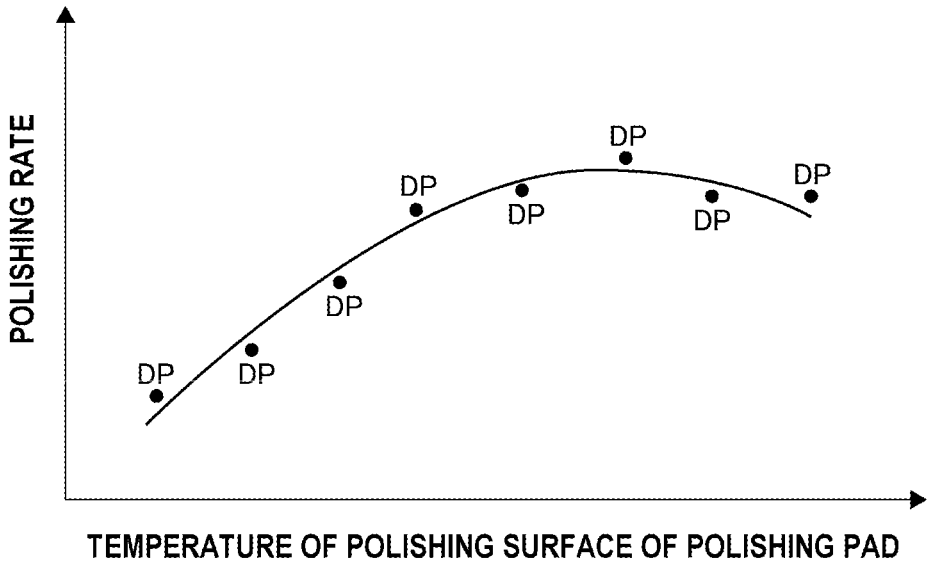
FIG. 7 is a graph showing a plurality of data points specified by respective polishing rates of a plurality of sample wafers and corresponding temperatures of the polishing surface.

FIG. 7 is a graph showing a plurality of data points specified by the respective polishing rates of the plurality of sample wafers and the corresponding temperatures of the polishing surface 3*a*. Each data point DP indicates a temperature of the polishing surface 3*a* of the polishing pad 3 when each sample wafer is polished and a polishing rate of that sample wafer. The operation controller 40 plots the plurality of data points DP on a coordinate system. This coordinate system has a vertical axis representing the polishing rate and a horizontal axis representing the temperature of the polishing surface 3*a*. The vertical axis may represent the temperature of the polishing surface 3*a*, and the horizontal axis may represent the polishing rate. The operation controller 40 determines an approximate line representing the plurality of data points DP by performing curve fitting or regression analysis on the plurality of data points DP on the coordinate system. This approximate line corresponds to a relational expression representing the correlation between the plurality of temperatures of the polishing surface 3*a* and the plurality of polishing rates.

Figure 8:
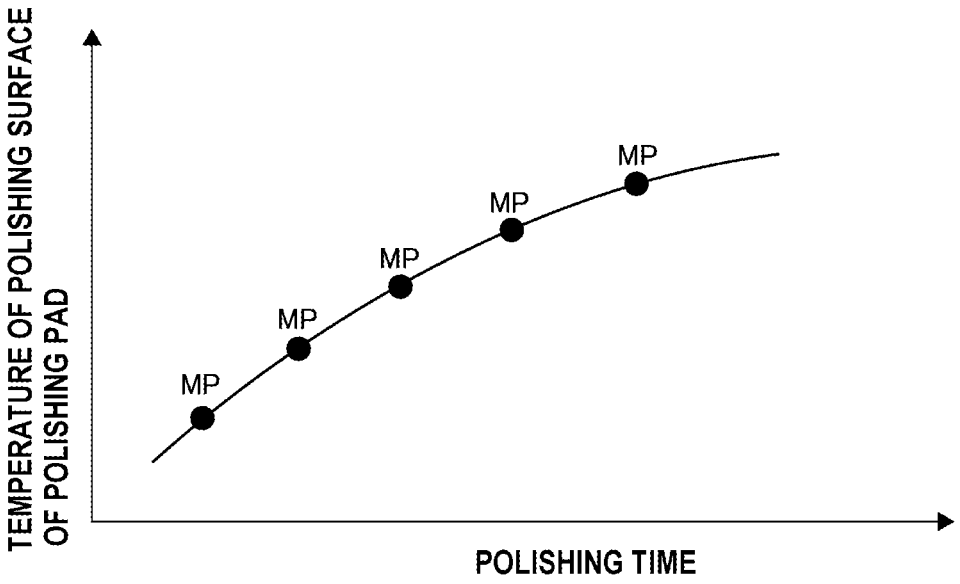
FIG. 8 is a diagram illustrating an example of creating the relational expression indicative of the correlation between the polishing rate and the temperature of the polishing surface shown in FIG. 4.

FIG. 8 is a diagram for explaining another example of creating the relational expression showing the correlation between the polishing rate and the temperature of the polishing surface 3*a* shown in FIG. 4. In this example, a single sample wafer prepared in advance is polished on the polishing surface 3*a* of the polishing pad 3 while the temperature of the polishing surface 3*a* is measured by the pad-temperature measuring device 39. The heat exchanger 11 is not used. During polishing of the sample wafer, the film thickness of the sample wafer is measured by the film-thickness sensor 7.

In this example, the adjustment of the temperature of the polishing surface 3*a* by the heat exchanger 11 is not performed. Therefore, as shown in FIG. 8, the temperature of the polishing surface 3*a* rises with the polishing time of the sample wafer. Typically, the polishing rate of the sample wafer changes depending on the temperature of the polishing surface 3*a*. Therefore, the operation controller 40 calculates a plurality of polishing rates of the sample wafer corresponding to a plurality of temperatures of the polishing surface 3*a*. Specifically, the operation controller 40 calculates amounts of change in film thickness in film-thickness measurement periods MP, and divides the amounts of change in film thickness by the corresponding film-thickness measurement periods MP, respectively, to thereby calculate multiple polishing rates. The temperature of the polishing surface 3*a* within each film-thickness measurement period MP is assumed to be constant.

The operation controller 40 obtains a plurality of measured values of the temperature of the polishing surface 3*a* at the film-thickness measurement periods MP from the pad-temperature measuring device 39. Further, the operation controller 40 plots, on a coordinate system, a plurality of data points specified by the plurality of measured values of the temperature of the polishing surface 3*a* and the corresponding polishing rates. This coordinate system is the same as the coordinate system shown in FIG. 7. The operation controller 40 determines an approximate line representing the plurality of data points by performing curve fitting or regression analysis on the plurality of data points on the coordinate system. This approximate line corresponds to a relational expression representing the correlation between the plurality of temperatures of the polishing surface 3*a* and the plurality of polishing rates.

Measurement data of the polishing surface 3*a* and film-thickness data of the wafer W obtained when the wafer W, which is a product wafer (product substrate), is polished may be used for creating and/or updating the above-described relational expression.

As shown in FIG. 4, the polishing rate of the wafer W changes depending on the temperature of the polishing surface 3*a* of the polishing pad 3 (i.e., the pad surface temperature). The polishing rate may also be affected by consumables of the polishing apparatus. The polishing apparatus generally has a plurality of consumables. Specific examples of the consumables include the polishing pad 3, a dresser, and an elastic membrane and a retainer ring of the polishing head 1.

Figure 9:
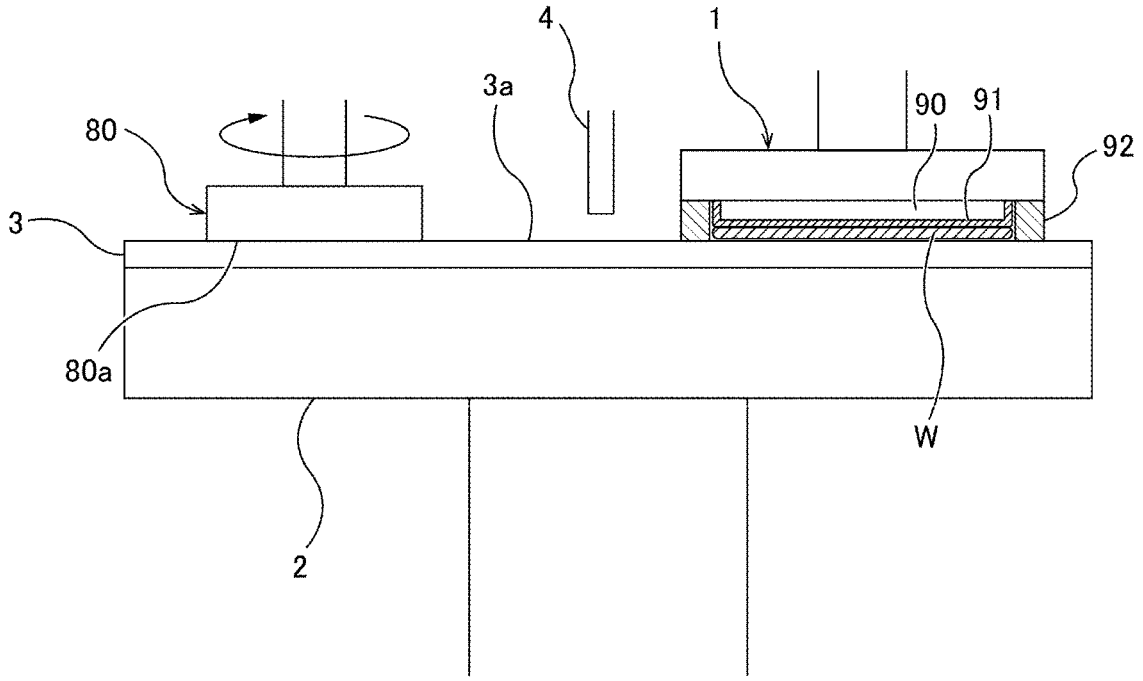
FIG. 9 is a schematic cross-sectional view of a polishing apparatus having a dresser.

FIG. 9 is a schematic cross-sectional view of a polishing apparatus including a dresser 80. For simplification of descriptions, the temperature regulation device 5 including the heat exchanger 11 described above is not shown in FIG. 9. The dresser 80 is a device for dressing (or regenerating) the polishing surface 3*a* of the polishing pad 3 after polishing of the wafer W or during polishing of the wafer W. The dresser 80 has a dressing surface 80*a* made of abrasive grains, such as diamond particles. The dresser 80 presses the dressing surface 80*a* against the polishing surface 3*a* of the polishing pad 3 while the dresser 80 is rotating about its axis. The polishing surface 3*a* is slightly scraped off by the dresser 80, whereby the polishing surface 3*a* is regenerated.

As dressing of the polishing pad 3 is repeated, the abrasive grains (diamond particles or the like) forming the dressing surface 80*a* gradually wear. As the wear of the abrasive grains progresses, the dresser 80 cannot properly dress the polishing surface 3*a* of the polishing pad 3, and as a result, a polishing rate of a wafer changes. Moreover, as dressing of the polishing pad 3 is repeated, the polishing pad 3 also wears (i.e., the thickness of the polishing pad 3 decreases). As the wear of the polishing pad 3 progresses, the properties of the polishing pad 3 change, and as a result, a polishing rate of a wafer changes.

As shown in FIG. 9, the polishing head 1 includes an elastic membrane (or a membrane) 91 that forms a pressure chamber 90 in the polishing head 1. During polishing of the wafer W, the pressure chamber 90 is filled with a pressurized gas. A lower surface of the elastic membrane 91 is in contact with the upper surface of the wafer W. The pressurized gas in the pressure chamber 90 presses the wafer W against the polishing surface 3*a* of the polishing pad 3 via the elastic membrane 91. The pressing force of the wafer W against the polishing pad 3 can be adjusted by the pressure of the gas in the pressure chamber 90. The elastic membrane 91 is made of a material such as silicone rubber. When the elastic membrane 91 is used for a long period of time, responsiveness (expansion and contraction) of the elastic membrane 91 deteriorates. As a result, a polishing rate of a wafer changes.

As shown in FIG. 9, the polishing head 1 further includes a retainer ring 92 arranged around the elastic membrane 91. The retainer ring 92, arranged around the wafer W, presses the polishing surface 3*a* of the polishing pad 3 while the retainer ring 92 is rotating together with the wafer W. The retainer ring 92 has not only a function of retaining the position of the wafer W being polished, but also a function of controlling a polishing rate of an edge portion of the wafer W. Since the retainer ring 92 is brought into sliding contact with the polishing surface 3*a*, the retainer ring 92 gradually wears, as polishing of a wafer is repeated. As the wear of the retainer ring 92 progresses, the force with which the retainer ring 92 presses the polishing pad 3 changes, and as a result, a polishing rate of a wafer changes.

As described above, the polishing rate may change due to the change (for example, wear) of the consumables, such as the polishing pad 3, with time. Therefore, in one embodiment, the operation controller 40 calculates a target polishing rate required for an actual polishing time (i.e., a time duration from the start of polishing the wafer W until the film thickness of the wafer W reaches a target thickness) to coincide with a target polishing time. During polishing of the wafer W, the operation controller 40 operates the fluid supply system 30 to allow the heat exchanger 11 to adjust the temperature of the polishing surface 3*a* such that a current polishing rate of the wafer W is maintained at the target polishing rate.

Specifically, in the example shown in FIG. 5, when the polishing time reaches the correction point T1 for the polishing rate, the operation controller 40 determines the target polishing rate R2 (=SP/RT) required for an actual polishing time (i.e., a time duration from the start of polishing the wafer W until the film thickness of the wafer W reaches the target thickness PT) to coincide with the target polishing time EP. Then, the operation controller 40 calculates a current polishing rate at each of points in time during polishing of the wafer W, and operates the fluid supply system 30 to adjust the temperature of the polishing surface 3*a* via the heat exchanger 11 such that the current polishing rate coincides with the target polishing rate R2. The current polishing rate is a polishing rate per unit time during polishing of the wafer. The operation controller 40 can calculate the current polishing rate from an amount of change in the film-thickness signal received from the film-thickness sensor 7 and the unit time.

As can be seen from the graph shown in FIG. 4, the polishing rate changes depending on the temperature of the polishing surface 3*a* of the polishing pad 3. Therefore, the operation controller 40 can maintain the target polishing rate by adjusting the temperature of the polishing surface 3*a* via the heat exchanger 11. More specifically, the operation controller 40 regularly or irregularly calculates the current polishing rate during polishing of the wafer W after the correction point T1 shown in FIG. 5, and controls the temperature regulation device 5, including the fluid supply system 30 and the heat exchanger 11, so as to minimize the difference between the current polishing rate and the target polishing rate R2. As a result of such feedback control operation, the polishing rate of the wafer W is maintained at the target polishing rate R2.

As a result, as shown in FIG. 5, when the film thickness of the wafer W reaches the target thickness PT, the polishing of the wafer W is terminated. The polishing time (i.e., the actual polishing time) of the wafer W at this time coincides with the target polishing time EP. Specifically, at the same time that the film thickness of the wafer W reaches the target thickness PT, the elapsed time from the start of polishing the wafer W reaches the target polishing time EP. The same operations are performed in the example shown in FIG. 6.

The polishing rate basically increases as the temperature of the polishing surface 3*a* of the polishing pad 3 increases. However, depending on slurry and/or material of a wafer surface to be polished, the polishing rate may decrease as shown in FIG. 4 when the temperature of the polishing surface 3*a* is too high. Therefore, the operation controller 40 is configured to operate the fluid supply system 30 to adjust the temperature of the polishing surface 3*a* by the heat exchanger 11 within a temperature range that does not exceed a predetermined upper limit temperature. The upper limit temperature is determined based on a temperature of the polishing surface 3*a* that maximizes the polishing rate. In one example, the upper limit temperature is a temperature of the polishing surface 3*a* that maximizes the polishing rate. The determined upper limit temperature is stored in the memory 110.

The previous embodiments described with reference to FIGS. 1 to 8 may be appropriately combined with the embodiment described with reference to FIG. 9. For example, the operation controller 40 calculates the target polishing rate, determines the target temperature of the polishing surface 3*a* that can achieve the target polishing rate, operates the fluid supply system 30 during polishing of the wafer W to change the temperature of the polishing surface 3*a* to the target temperature by the heat exchanger 11, then calculates a current polishing rate at each of a plurality of points in time during polishing of the wafer W, and operates the fluid supply system 30 to adjust the temperature of the polishing surface 3*a* via the heat exchanger 11 such that the current polishing rate coincides with the target polishing rate.

Figure 10:
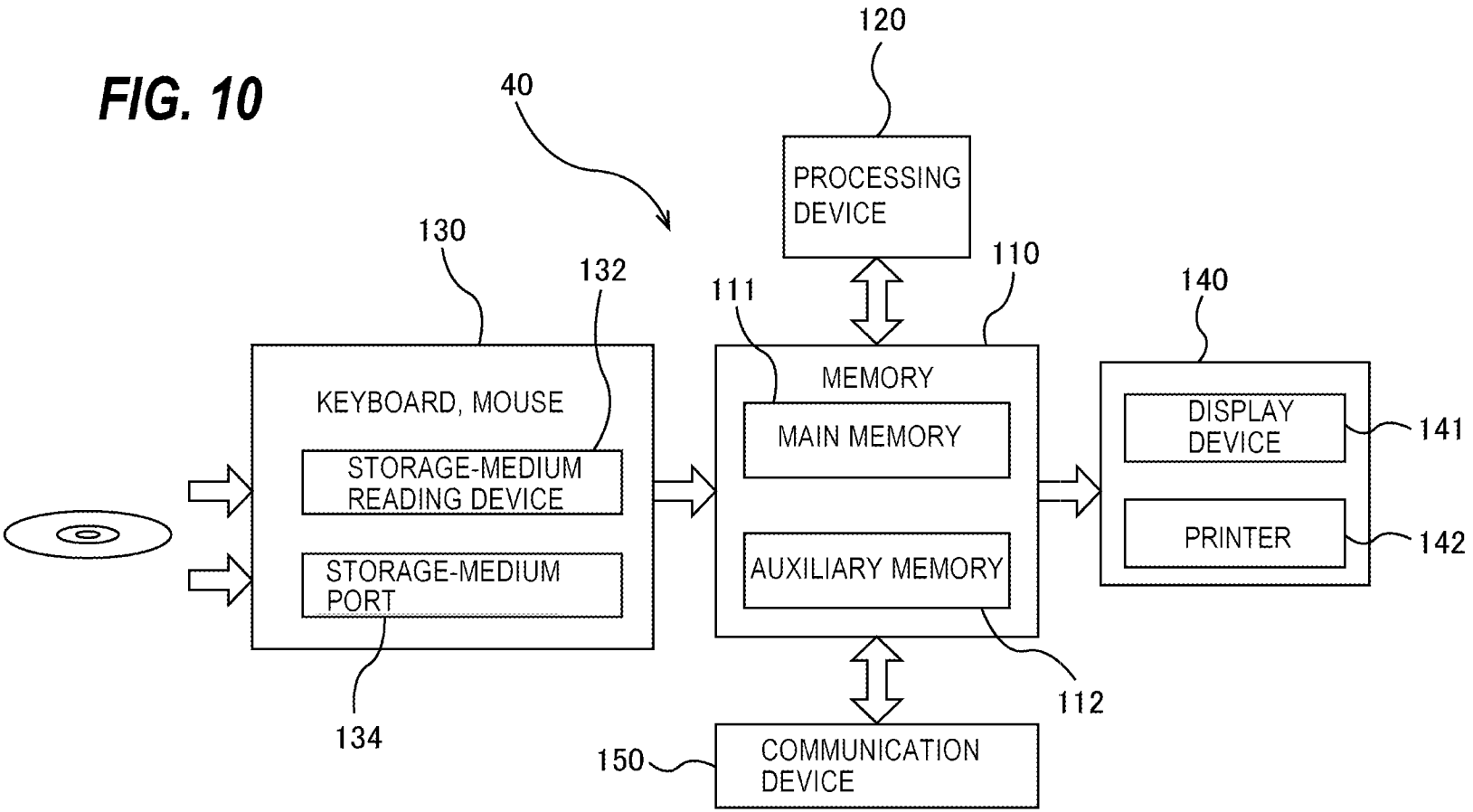
FIG. 10 is a schematic view showing an example of a configuration of an operation controller.

The operation controller 40 is constituted by at least one computer. FIG. 10 is a schematic view showing an example of a configuration of the operation controller 40. As shown in FIG. 10, the operation controller 40 includes the memory 110 in which a program and data are stored, the processing device 120, such as CPU (central processing unit) or GPU (graphics processing unit), for performing arithmetic operation according to instructions contained in the program stored in the memory 110, an input device 130 for inputting the data, the program, and various information into the memory 110, an output device 140 for outputting processing results and processed data, and a communication device 150 for connecting to a communication network, such as the Internet or local area network.

The memory 110 includes a main memory 111 which is accessible by the processing device 120, and an auxiliary memory 112 that stores the data and the program therein.

The main memory 111 may be a random-access memory (RAM), and the auxiliary memory 112 is a storage device which may be a hard disk drive (HDD) or a solid-state drive (SSD).

The input device 130 includes a keyboard and a mouse, and further includes a storage-medium reading device 132 for reading the data from a storage medium, and a storage-medium port 134 to which a storage medium can be coupled. The storage medium is a non-transitory tangible computer-readable storage medium. Examples of the storage medium include optical disk (e.g., CD-ROM, DVD-ROM) and semiconductor memory (e.g., USB flash drive, memory card). Examples of the storage-medium reading device 132 include optical drive (e.g., CD-ROM drive, DVD-ROM drive) and memory reader. Examples of the storage-medium port 134 include USB port. The program and/or the data stored in the storage medium is introduced into the operation controller 40 via the input device 130, and is stored in the auxiliary memory 112 of the memory 110. The output device 140 includes a display device 141 and a printer 142.

The operation controller 40 operates according to the instructions included in the program electrically stored in the memory 110. In one embodiment, the operation controller 40 performs the steps of: calculating a target polishing rate required for an actual polishing time (i.e., a time duration from the start of polishing the wafer W until the film thickness of the wafer W reaches a target thickness) to coincide with a target polishing time; determining a target temperature of the polishing surface 3*a* that can achieve the calculated target polishing rate, and operating the fluid supply system 30 during polishing of the wafer W to change the temperature of the polishing surface 3*a* to the target temperature by the heat exchanger 11. In another embodiment, the operation controller 40 performs the steps of: calculating a target polishing rate required for an actual polishing time (i.e., a time duration from the start of polishing the wafer W until the film thickness of the wafer W reaches a target thickness) to coincide with a target polishing time; and operating the fluid supply system 30 during polishing of the wafer W to adjust the temperature of the polishing surface 3*a* by the heat exchanger 11 such that a current polishing rate of the wafer W is maintained at the target polishing rate.

The program for causing the operation controller 40 to perform the above steps is stored in a non-transitory tangible computer-readable storage medium. The operation controller 40 is provided with the program via the storage medium. The operation controller 40 may be provided with the program via a communication network, such as the Internet or local area network.

The previous description of embodiments is provided to enable a person skilled in the art to make and use the present invention. Moreover, various modifications to these embodiments will be readily apparent to those skilled in the art, and the generic principles and specific examples defined herein may be applied to other embodiments. Therefore, the present invention is not intended to be limited to the embodiments described herein but is to be accorded the widest scope as defined by limitation of the claims.

What is claimed is:

1. A polishing apparatus comprising:

a polishing table for supporting a polishing pad;

a polishing head configured to polish a substrate by pressing the substrate against a polishing surface of the polishing pad;

a heat exchanger having a heating flow passage and a cooling flow passage therein, the heat exchanger being arranged above the polishing table;

a pad-temperature measuring device configured to measure a temperature of the polishing surface;

a fluid supply system having a heating-fluid supply pipe and a cooling-fluid supply pipe coupled to the heating flow passage and the cooling flow passage, respectively;

a film-thickness sensor attached to the polishing table; and an operation controller having a memory and a processing device, the memory storing a program therein, the processing device being configured to perform an arithmetic operation according to an instruction contained in the program, the operation controller being configured to calculate a target polishing rate required for an actual polishing time to coincide with a target polishing time, the actual polishing time being a time duration from start of polishing the substrate until a film thickness of the substrate reaches a target thickness, and operate the fluid supply system during polishing of the substrate to adjust a temperature of the polishing surface by the heat exchanger such that a current polishing rate of the substrate is maintained at the target polishing rate.

2. The polishing apparatus according to claim 1, wherein the operation controller is configured to:

calculate a remaining film thickness by subtracting the target thickness from a film thickness of the substrate at a present point in time;

calculate a remaining time by subtracting an elapsed time from the target polishing time, the elapsed time being a period of time from start of polishing the substrate to the present point in time; and divide the remaining film thickness by the remaining time to calculate the target polishing rate.

3. The polishing apparatus according to claim 1, wherein the operation controller is configured to allow the heat exchanger to adjust the temperature of the polishing surface within a temperature range that does not exceed a predetermined upper limit temperature, the upper limit temperature being determined based on a temperature of the polishing surface that maximizes a polishing rate of the substrate.

* * * * *